US005500658A

United States Patent [19]

Hattori et al.

[11] Patent Number: 5,500,658

[45] Date of Patent: Mar. 19, 1996

[54] INK JET RECORDING APPARATUS HAVING A HEATING MEMBER AND MEANS FOR REDUCING MOISTURE NEAR AN INK DISCHARGE PORT OF A RECORDING HEAD

[75] Inventors: Yoshifumi Hattori, Yamato; Genji Inada, Atsugi; Kenjiro Watanabe, Tokyo, all of Japan

[73] Assignee: Canon Kabushiki Kaisha, Tokyo, Japan

[21] Appl. No.: 275,744

[22] Filed: Jul. 20, 1994

Related U.S. Application Data

[63] Continuation of Ser. No. 976,663, Nov. 16, 1992, abandoned, which is a continuation of Ser. No. 789,545, Nov. 8, 1991, abandoned, which is a continuation of Ser. No. 541,194, Jun. 22, 1990, abandoned, which is a continuation of Ser. No. 242,913, Sep. 12, 1988, abandoned.

[30] Foreign Application Priority Data

| | | | |
|---|---|---|---|
| Sep. 11, 1987 | [JP] | Japan | 62-226621 |
| Sep. 11, 1987 | [JP] | Japan | 62-226622 |
| Sep. 9, 1988 | [JP] | Japan | 63-224575 |

[51] Int. Cl.[6] ..... B41J 2/01

[52] U.S. Cl. ..... 347/22; 347/44; 347/102

[58] Field of Search ..... 347/22, 29, 31, 347/34, 44, 102, 18; 355/215, 30

[56] References Cited

U.S. PATENT DOCUMENTS

| | | | |
|---|---|---|---|
| 4,024,548 | 5/1977 | Alonso | 347/34 |
| 4,361,845 | 11/1982 | Smith | 347/34 |
| 4,578,686 | 3/1986 | Vollert | 347/44 |
| 4,645,327 | 2/1987 | Kimura | 355/30 X |
| 4,693,588 | 9/1987 | Yarbrough | 355/3 R |
| 4,727,385 | 2/1988 | Nishikawa | 347/152 |
| 4,751,528 | 6/1988 | Spehrley | 347/18 X |
| 4,774,523 | 9/1988 | Beaufort | 347/102 X |

*Primary Examiner*—Joseph W. Hartary
*Attorney, Agent, or Firm*—Fitzpatrick, Cella, Harper & Scinto

[57] ABSTRACT

An ink jet recording apparatus including a heating member for heating a recording medium in order to accelerate the fixation and adhering of liquid ink being discharged from a recording head onto the recording medium, wherein the heating of the recording medium promotes the evaporation of the liquid ink but creates moisture in the area of the recording head. A moisture condensation preventing member positioned near the recording head decreases the moisture in the vicinity of the recording head. This prevents condensation of this moisture on the recording head, which can lead to faulty recording.

35 Claims, 11 Drawing Sheets

INK JET RECORDING APPARATUS HAVING A HEATING MEMBER AND MEANS FOR REDUCING MOISTURE NEAR AN INK DISCHARGE PORT OF A RECORDING HEAD

This application is a continuation of application Ser. No. 07/976,663 filed Nov. 16, 1992, now abandoned, which is a continuation of application Ser. No. 07/789,545 filed Nov. 8, 1991, abandoned, which is a continuation of application Ser. No. 07/541,194 filed Jun. 22, 1990, abandoned, which is a continuation of application Ser. No. 07/242,913 filed Sep. 12, 1988, abandoned.

BACKGROUND OF THE INVENTION

1. Field of the Invention

This invention relates to an ink jet recording apparatus, and in particular to an ink jet recording apparatus provided with a fixating heater for expediting the fixation of ink adhering as recorded images to a recording medium.

2. Related Background Art

An ink jet recording apparatus-has many merits such as very small noise during recording and the possibility of high-density recording, and has been drawing growing attention as a recording apparatus in recent years.

Also, the ink jet recording apparatus has a great merit in that plain paper can be chosen as a recording medium, but depending on the combination of recording paper and ink used, there may sometimes arise a problem as to the fixativeness of ink on the recording paper. That is, the ink jet recording apparatus uses as a recording agent ink which is liquid and therefore, where the ink absorbing property of the recording medium for the ink used is inferior, the ink does not quickly permeate into the recording medium and the ink which cannot be absorbed into the recording medium remains in the form of liquid on the recording medium.

By such a condition occurring, conveying members such as rollers are contaminated and such ink is transferred to the surface of a succeeding recording medium, which has sometimes led to remarkable deterioration of the recording quality. Further, when the operator handles a recorded recording medium on which the fixation of ink is insufficient, the ink not only has contaminated the operator's hands, but the hands have also inadvertently rubbed the formed image thereby disturbing the quality of the image. Or in the case of an apparatus in which recorded recording mediums are piled on a discharge tray or the like, there have sometimes been caused problems, such as deterioration of the quality of the image and contamination by the rubbing between the recording mediums.

As a technique for preventing such problems and enhancing the fixativeness of ink on the recording medium, there is an apparatus in which a heater is used to heat the recording medium and expedite the evaporation of the water content contained in ink, thereby causing the ink on the recording medium to be quickly dried and fixated. From the requirements for shortening the length of the conveyance path of the recording medium and quickening the fixation of the ink for the prevention of the contamination of conveying members, the fixating heater is disposed near a recording station by a recording head, for example, on a platen opposed to the recording head for controlling the recording surface of the recording medium so as to be flat. Also, with attention being paid to the fact that if the recording medium is dry, the ink absorbing property thereof is enhanced, a heater is sometimes provided upstream of the recording station in the conveyance path to preheat and dry the recording medium.

A further cause which disturbs the quality of recorded images, is the problem of moisture condensation, such as dew formation in the ink jet recording apparatus. That is, the problem is that in the environment in which the apparatus is used, water content or the like which has condensed in the apparatus adheres to the recording medium to cause the ink to blot on the recording medium. The problem resulting from such moisture condensation could not be solved simply by providing a fixating heater.

So, the inventors have focused their attention on the electrophotographic technique which is a different field of art, in order to prevent moisture condensation, and have conceived of the application of a moisture condensation preventing device used in an electrophotographic copying apparatus to an ink jet recording apparatus. It is, for example, the method described in Japanese Laid-open Pat. Application No. 55-35390 wherein a plurality of temperature sensors, a humidity sensor and a plurality of heaters provided in a paper supply portion, an optical system and a fixating device, respectively, are heat-controlled, or the method described in Japanese Laid-open Pat. Application No. 56-80061 wherein in addition to said method, removal of humidity is effected by a blower.

However, simple application of these methods to an ink jet recording apparatus has posed several problems: for example, (1) the provision of a plurality of moisture condensation preventing heaters in addition to the fixating heater makes the entire apparatus bulky; and (2) the heat from the moisture condensation preventing heaters affects the viscosity of ink to reduce the stability of the recording characteristic. In addition, it has been made clear on the basis of the inventors' experiment that the causes of the moisture condensation occurring in the ink jet recording apparatus and the influence thereof are due chiefly to the reasons set forth below.

That is, according to the inventors' experiment, it is at a temperature on the order of 80°–60° C. of the recording medium that no warp occurs to the recording medium and, moreover, good and quick fixation takes place. On the other hand, the recording head is kept on the order of 20°–40° C. with parameters which affect the stability of discharge, such as the viscosity of ink being taken into account, and this temperature is lower than the ambient temperature of the recording head.

Since the apparatus is operated under such environmental conditions, the recording head (particularly in the vicinity of its discharge ports) becomes a high-humidity atmosphere due to the evaporation of water content from the recording medium and the evaporation of the water content contained in the ink caused by the heating for fixation, and moisture condensation occurs on the surface of the recording head in which the ink discharge ports are provided (hereinafter referred to as the discharge surface). Generally, in the ink jet recording system, in order to improve the quality of recording, it is required that ink droplets adhere to a desired position on the recording surface, that is, the direction of discharge and flight of ink droplets used for recording should be constant, the speed of discharge should be constant and the particle diameters of the flying ink droplets should be uniform.

However, if moisture condensation occurs on the discharge surface, particularly, around the discharge ports, water drops or the like adhere non-uniformly to the portion around the discharge ports, and when the ink is discharged from the ink discharge ports, such water drops pull the discharged ink non-uniformly and therefore, the direction of discharge, the speed of discharge and the particle diameters of the ink droplets become irregular, thus resulting in the deterioration of the quality of recording. Also, the wetting of the discharge surface makes paper powder, dust or the like readier to adhere thereto, and this causes the deterioration of the quality of recording.

As described above, it has been found, as a result of numerous experiments carried out by the inventors and the detailed studies thereof, that the problem of moisture condensation cannot be solved unless consideration, is fully given to optimum conditions such as the fixation temperature in the ink jet recording apparatus and the temperature of the recording head.

SUMMARY OF THE INVENTION

It is an object of the present invention to solve such a problem and to provide an ink jet recording apparatus in which moisture condensation on the discharge surface is prevented to the utmost in order to stabilize the direction of discharge, and the speed of discharge of ink, and the particle diameters of ink droplets, thereby preventing deterioration of the quality of recording.

It is another object of the present invention to provide an ink jet recording apparatus in which the vicinity of a recording area, particularly the vicinity of the discharge surface of a recording head, is kept in a low-humidity atmosphere, whereby recorded images of very high quality can be provided.

It is still another object of the present invention to provide an ink jet recording apparatus with a heater for heating a recording medium to expedite the fixation and adhering of ink discharged from a recording head to the recording medium, characterized in that a moisture condensating member, readier to create moisture condensation than the component members of the recording head, is provided near a surface in which the discharge ports of the recording head are provided.

It is yet still another object of the present invention to provide an ink jet recording apparatus in which steam produced by the evaporation of the water content in ink caused by the heat of a heater and the evaporation of water content contained in a recording medium is positively formed into dew on a moisture condensation member, whereby moisture condensation on a surface in which the ink discharge ports of a recording head are provided can be prevented.

It is a further object of the present invention to provide an ink jet recording apparatus with a heater for heating a recording medium to expedite the fixation of ink discharged from a recording head for effecting the discharge of the ink and adhering to the recording medium, characterized in that a moisture absorbing member is provided near a surface in which the ink discharge ports of the recording head are provided.

It is still a further object of the present invention to provide an ink jet recording apparatus in which steam produced by the evaporation of water content in ink caused by the heat of a heater and the evaporation of water content contained in a recording medium is forcibly absorbed into a moisture absorbing member, whereby moisture condensation on a surface in which the ink discharge ports of a recording head are provided can be prevented.

It is yet still a further object of the present invention to provide an ink jet recording apparatus of compact construction in which moisture condensation on the discharge surface of a recording head can be prevented and which is excellent in maintainability and can ensure recorded images of stable quality to be obtained.

DESCRIPTION OF THE PREFERRED EMBODIMENTS

[Embodiment 1]

Figure 1:
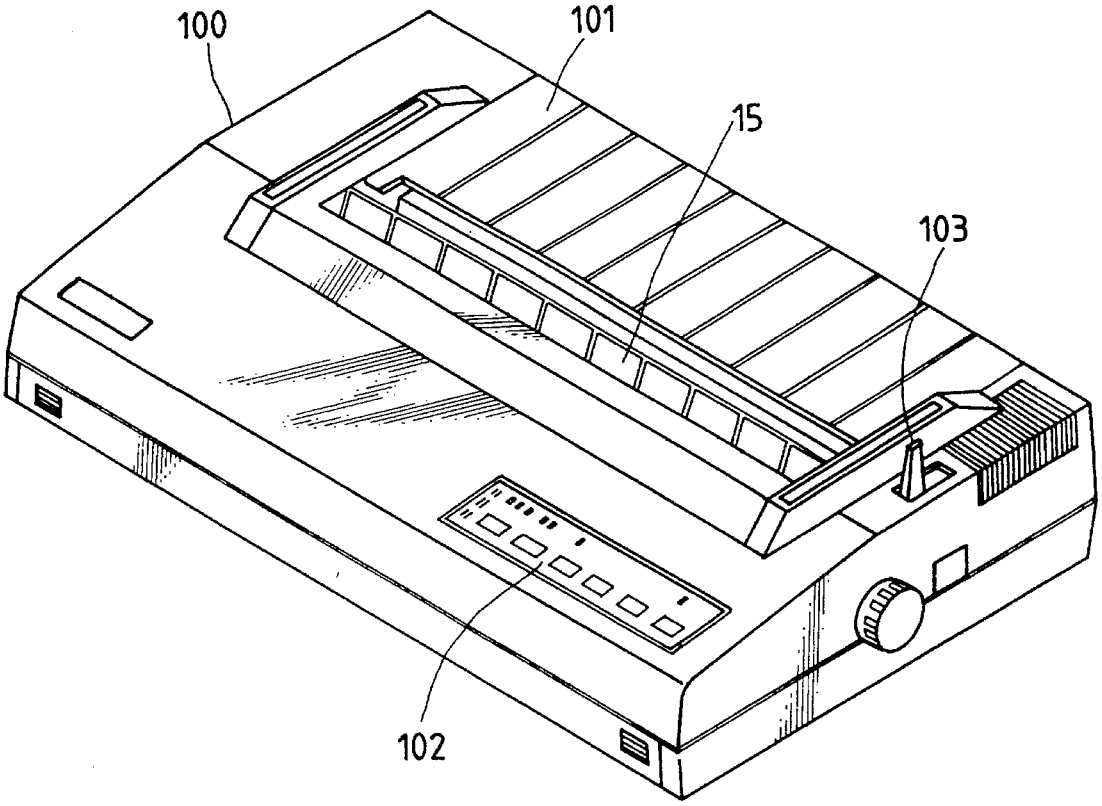
FIG. 1 is a schematic pictorial perspective view showing an embodiment of an ink jet recording apparatus to which the present invention is applicable.

The present invention will hereinafter be described in detail with respect to some embodiments thereof shown in the drawings.

FIG. 1 is a schematic pictorial perspective view of an ink jet recording apparatus (hereinafter referred to as the ink jet printer or simply as the printer) according to an embodiment of the present invention. In FIG. 1, the reference numeral 100 designates the ink jet printer body. The reference numeral 15 denotes a sheet discharge guide forming a part of a sheet discharge port provided in the central portion of the upper lid of the printer 100, and the reference numeral 101 designates a sheet discharge tray provided continuously with the sheet discharge guide 15 and forming a part of the upper lid of the printer 100. Recording mediums such as recording sheets on which recording has been completed are discharged out of the ink jet printer body 100 having their discharge path controlled by the sheet discharge guide 15 and are piled on the sheet discharge tray 101.

The reference numeral 102 denotes an operating panel provided on a portion of the upper lid of the printer 100 provided with keys for various operation inputs which will be described later and a display lamp for notifying the operator of the operating conditions or the like of various portions in the printer. The reference numeral 103 designates a sheet setting lever protruding through an opening formed at one end of the upper lid of the printer 100. By operating the sheet setting lever 103, a mechanism hereinafter described in connection with FIG. 2 and 3, is operated to make the supply of recording sheets easy.

Figure 2:
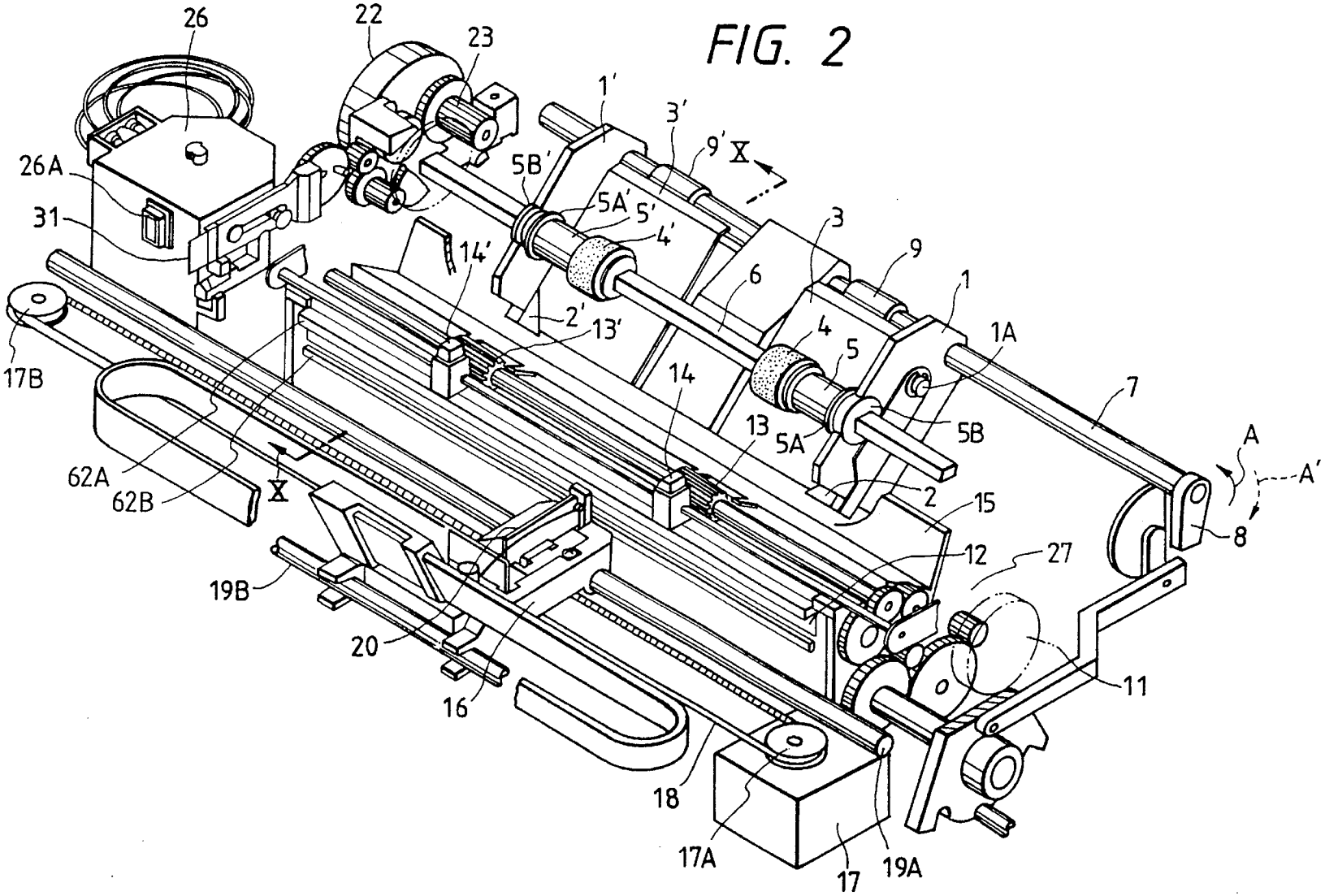
FIGS. 2 and 3 are a schematic perspective view and a cross-sectional view along the line X—X thereof, respectively, of the FIG. 1 apparatus with its outer cover removed.

FIG. 2 is a schematic perspective view of the FIG. 1 printer with its outer cover removed.

Figure 3:
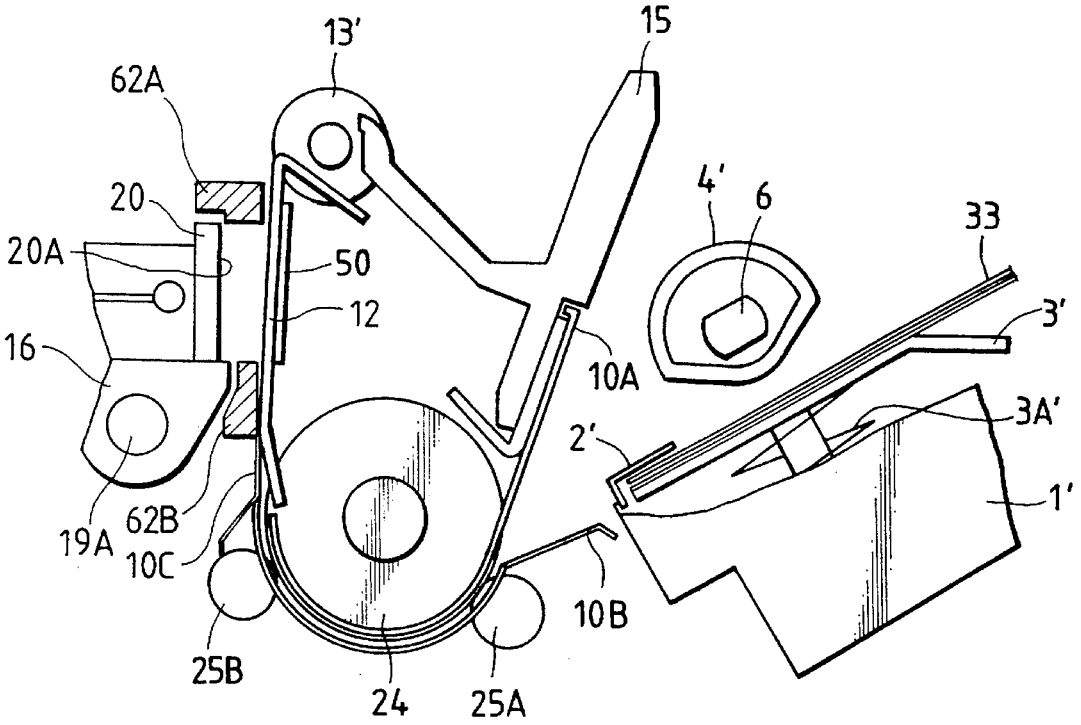

FIG. 3 is a schematic cross-sectional view taken along line X—X in FIG. 2.

In FIG. 2 and 3, the reference numerals 1 and 1' designate sliders forming a part of a recording medium containing portion and slidably provided on a slider shaft 7. By sliding each of these sliders 1 and 1' along the slider shaft 7, the slider can be made to correspond to the width of recording mediums 33. The reference numerals 2 and 2' denote separating pawls provided on the sliders 1 and 1', respectively, for cooperating separating rollers 4 and 4' to separate and supply the recording mediums 33 one by one. The reference numerals 3 and 3' designate pressure plates forming the bottom plate of the recording medium containing portion. The pressure plates 3 and 3' each have one end thereof pivotably supported on shafts 1A provided in the sliders 1 and 1', respectively. The pressure plates 3 and 3' are also biased upwardly by being pivotally moved about the shafts 1A and 1A' by push-up springs 3A and 3A', respectively, whereby irrespective of the number of the stored recording mediums 33, appropriate engagement between the recording mediums 33 and a separating roller shaft which will be described later becomes possible.

The reference numerals 5 and 5' denote connecting members slidable along the separating roller shaft 6 and holding separating rollers 4 and 4', respectively, and having connection members 5A, 5B and 5A', 5B', respectively, for coupling the sliders 1 and 1'.

That is, the separating roller 4, the connecting member 5 and the connection members 5A and 5B are combined integrally with one another and are slidable along the slider shaft 7 and the separating roller shaft 6. The separating roller 4', the connecting member 5' and the connection members 5A' and 5B' are likewise combined integrally with one another.

When by the above-described construction, the sliders 1 and 1' are slid correspondingly to the width of the recording mediums 33, the separating rollers and 4' are displaced on the separating roller shaft 6 with the sliding movement of the sliders. Also, the pressure plates 3 and 3' and the separating pawls 2 and 2' are combined with the sliders 1 and 1', respectively, and therefore they are likewise displaced with the sliding movement of the sliders 1 and 1'.

The reference numeral 8 designates a lever provided at one end of the slider shaft 7 for rotating the slider shaft 7. The reference numerals 9 and 9' denote pressure plate push-down arms secured to the slider shaft 7 and engageable with the pressure plates 3 and 3', respectively. With the rotation of the slider shaft 7 in the direction of arrow A', the pressure plate push-down arms 9 and 9' rotate the pressure plates 3 and 3' counter-clockwise about the shaft 1A as viewed in FIG. 2. That is, lever 8 is rotated in the direction of arrow A' by the operation of the aforementioned sheet setting lever 103, whereby the pressure plate push-down arms 9 and 9' push down the pressure plates 3 and 3' against the biasing forces of the push-up springs 3A and 3A'. As a result, the engagement between the pressure plate 3 and the separating pawl 2 and the engagement between the pressure plate 3' and the separating pawl 2' are released, whereby supply of the recording mediums 33 becomes easy.

The reference numeral 22 designates an auto sheet feed (ASF) motor coupled to one end of the separating roller shaft 6 through a transmission mechanism 23. The rotative drive force of the ASF motor 22 is transmitted to the separating roller shaft through the transmission mechanism 23, whereby the separating rollers 4 and 4' are rotated counter-clockwise as viewed in FIG. 2 and cooperates with the separating pawls 2 and 2' to separate the recording mediums 33 one by one and feed them to the paper feed path.

The reference numeral 24 denotes a sheet feeding roller disposed at an appropriate location to which the recording mediums 33 are supplied by the separating rollers 4 and 4'. The reference characters 10A and 10B designate sheet guides provided at an appropriate interval substantially along the circumference of the sheet feeding roller 24 from the inlet portion for the recording mediums from the slider to a platen 12. The interval formed by the sheet guides 10A and 10B forms the sheet feed path of the recording mediums. Designated by 10C is a sheet keeper for controlling the behavior of the recording mediums 33 and bringing them into intimate contact with the platen 12. Denoted by 25A and 25B are pinch rollers disposed at two points near the circumference of the sheet feeding roller 24 and bearing against the sheet feeding roller 24 through holes formed in the sheet guides 10A and 10B. The pinch rollers 25A and 25B obtain a biasing force from a spring, not shown, and urge the recording medium 33 in the sheet guides 10A and 10B against the sheet feeding roller 24.

The reference numeral 11 designates a sheet feed motor coupled to one end of the sheet feeding roller 24 through a transmission mechanism 27. That is, the rotative drive force of the sheet feed motor 11 is transmitted to the sheet feeding roller 24 through the transmission mechanism 27, whereby the sheet feeding roller 24 is rotated to convey the recording mediums 33.

The reference numeral 12 denotes a platen disposed above the sheet feeding roller 24 and extending over the full width of the recording mediums 33 and forming the recording surface by a recording head flatly, and the reference numerals 13 and 13' designate paper discharge rollers disposed along the conveyance path downstream of the platen 12. The reference numerals 14 and 14' denote sheet sensors provided correspondingly to the sheet discharge rollers 13 and 3', respectively, for detecting the setting or conveyance and, further, discharge of the recording medium 33. By the arrangement of the above-described platen 12 and sheet discharge rollers 13 and 13', the recording medium 33 on which recording has been completed is discharged to above the printer 100 and directed onto the sheet discharge tray 101 by the sheet discharge guide 15.

The reference numeral 50 designates a fixating heater mounted on that surface of the platen 12 which is opposite to the surface of the platen which contacts with the recording medium 33. The platen 12 is heated by the fixating heater 50 and the heat of the platen 12 is transferred to the recording medium 33, whereby the recording medium 33 itself or the ink on the recording medium 33 on which recording has been, completed can be dried by such heat which promotes evaporation.

The reference numeral 20 denotes a recording head opposed to the recording surface of the recording medium 33 controlled by the platen 12 and provided with a group of discharge ports for discharging ink. An electro-thermal conversion element or an electro-mechanical conversion element as energy producing means for producing energy utilized for the discharge of the ink is disposed at an appropriate location in an ink liquid path communicating with these discharge ports. In the case of the electro-thermal conversion element, heat energy is caused to act on the ink in response to the supply of a driving signal, and by the utilization of the change in the state of the ink caused by the heat produced thereby, the ink is discharged from the discharge ports.

Figure 4:
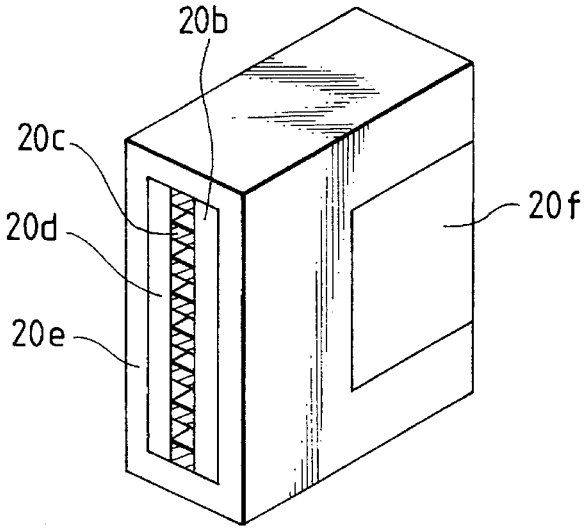
FIG. 4 is a schematic view showing the recording head of the ink jet recording apparatus according to the present invention.

Here, the discharge surface 20A of the recording head 20, as shown in FIG. 4, comprises a layered structure of a substrate 20*b* formed, for example, of silicon or the like, a path wall 20*c* formed of photosensitive resin or the like and a top plate 20*d* formed of glass or the like, and a head cover 20*e* formed of resin or the like, etc. are provided around the layered structure.

Heating means 20*f* or the like is provided to keep the discharged condition of the ink good, and the temperature of the recording head 20 is regulated, for example, to 20°–40° C.

The reference numeral 16 designates a carriage for holding the recording head 20. The carriage 16 is made reciprocally movable over the full width of the recording medium 33 by being secured to a driving belt 18 and being made slidable relative to two guide shafts 19A and 19B disposed parallel to the direction in which the platen 12 extends.

The reference numeral 17 denotes a head driving motor disposed near one end of the reciprocal movement path of the recording head 20, and a pulley 17A is mounted on the rotary shaft of the head driving motor 17. A pulley 17B is disposed at the other end of the reciprocal movement path of the head 20, and the belt 18 is passed over the pulleys 17A and 17B. That is, the rotative drive force of the head driving motor 17 is converted into a rectilinear drive force by the belt 18 and transmitted to the carriage 16 coupled to the belt 18. Thereby, the recording head 20 is reciprocally moved over the full width of the recording medium 33.

The reference numeral 26 designates a head discharge recovering device disposed at one end of the movement path of the recording head 20 outside the recording range, for example, the home position. By the above-described transmission mechanism 23 being appropriately constructed, in response to the drive of the ASF motor 22, the device 26 can perform the operation of capping the recording head 20 by a cap member 26A formed of an elastic material such as silicone rubber or butyl chloride rubber and the operation of retracting from the movement path of the recording head 20. In association with the capping of the recording head 20 by the head discharge recovering device 26, ink suction by suitable suction means provided in the head discharge recovery device 26 or ink pressure supply by suitable pressurizing means provided in the ink supply path to the recording head 20 is effected to forcibly discharge the ink from the discharge ports, whereby the discharge recovering process such as removing bubbles and viscosity-increased ink in the nozzle can be accomplished. Also, by effecting the capping as at the end of recording, the protection of the head is ensured during non-use.

The reference numeral 31 denotes a blade as a wiper member formed, for example, of silicone rubber or like material which is disposed on a side of the head discharge recovering device 26 and engageable with the discharge surface of the recording head 20. Like the head discharge recovering device 26, this blade 31 can accomplish engagement and disengagement with the recording head 20 conforming to the drive of the ASF motor 22 by the appropriate construction of the transmission mechanism 23. That is, at an appropriate timing in the reciprocal movement of the recording head 20, or after the discharge recovering process using the head discharge recovering device 26, blade 31 is protruded into the movement path of the recording head 20 to wipe the ink overflowing to the vicinity of the end of the nozzle of the head 20 in association with the reciprocal movement of the head 20. The construction of the transmission mechanism 23 for effecting separation and supply of the recording mediums 33, capping and wiping by the single motor 22, or the construction for effecting the driving of a pump provided as suction means in the head discharge recovering device 26 and separation and supply of the recording mediums by the single motor may be that disclosed, for example, in applicant's Japanese Patent Application No. 61-81637 or No. 61-197201.

Further, in FIGS. 2 and 3, the reference characters 62A and 62B designate moisture condensing members disposed downstream and upstream, respectively, of the recording station on the conveyance path of the recording mediums and formed of a material readier to form dew than the recording head 20. These moisture condensing members are constructed and arranged along the surface of the platen 12 in parallelism to the direction of movement of the recording head 20 so as not to hamper the recording operation of the recording head 20 by the discharge of liquid droplets, the conveyance of the recording mediums 33 and the movement of the recording head 20 and the carriage 16. That is, the steam produced from the recording medium 33, such as paper, by the temperature rise of the recording medium 33 resulting from the driving of the fixating heater 50 or the steam produced by the evaporation of the water content in the ink is formed into dew on the moisture condensing members 62A and 62B rather than on the discharge surface 20A of the recording head 20, whereby the amount of steam in the atmosphere near the discharge surface 20A is decreased and thus, moisture condensation on the discharge surface 20A can be prevented.

The material which can be chosen for the members readier to form dew than the recording head 20, i.e., the moisture condensing members 62A and 62B, may be a material which is good in heat conductivity and can maintain a temperature lower than the temperature of the recording head 20, e.g. 40° C., and preferably a temperature lower than 20° C., in the same atmosphere. For example, if the recording head 20 is of the aforedescribed construction or is formed of a material such as plastics, glass, ceramics or silicon, a material which is higher in heat conductivity than these, for example, a metal material such as aluminum or copper could be used.

[Embodiment 2]

Figure 5:
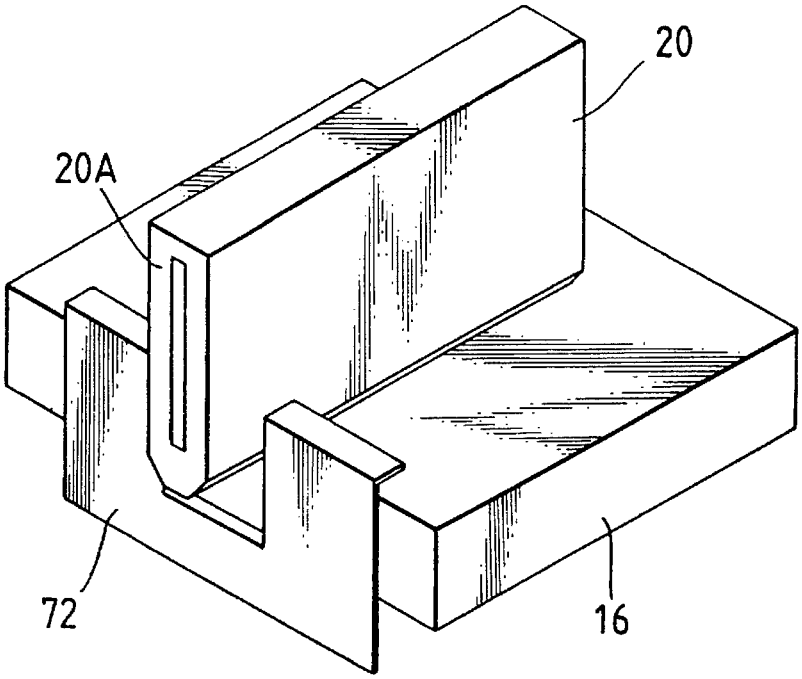
FIG. 5 is a schematic perspective view showing the essential portions of another embodiment of the ink jet recording apparatus according to the present invention.

FIG. 5 shows another embodiment of the present invention. In this embodiment the basic construction of the apparatus is similar to that previously described. In this embodiment, a moisture condensing member 72 readier to form dew than the recording head 20 in the same outside atmosphere is formed into a plate-like shape and is provided near the discharge surface 20A of the head. Again for this moisture condensing member 72, a material similar to that mentioned in the above-described embodiment 1 can be chosen and used, and again by this embodiment, the moisture condensation on the discharge surface 20A can likewise be prevented effectively.

[Embodiment 3]

Figure 6:
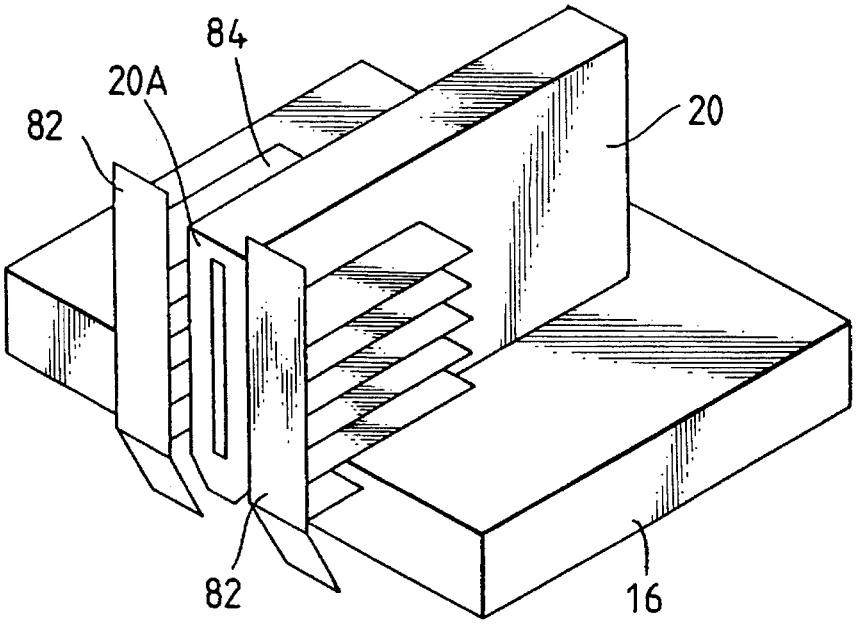
FIG. 6 is a schematic perspective view showing the essential portions of another embodiment of the present invention.

FIG. 6 shows still another embodiment of the present invention. The difference of this embodiment from the previously described embodiment is that plate-like moisture condensing members 82 each having a surface parallel to the discharge surface 20A are provided near the discharge surface 20A at opposite sides of the recording head 20 with said surface biased somewhat more toward the platen 12 than the discharge surface 20A, for example, by about ½ of the distance between the discharge ports and the recording surface. Also, the moisture condensing members 82 are provided with radiation fins 84 to make the radiation area large and reduce the temperature of the moisture condensing members 82.

According to the present embodiment, the temperature of the moisture condensing member 82 is effectively dropped by the radiation fins 84, whereby moisture condensation occurs more readily. Also, the moisture condensing members 82 are biased more toward the platen 12 than the discharge surface 20A and therefore, the steam coming in from the platen 12 side is collected by the moisture condensing members 82 before it arrives at the discharge surface 20A and thus, the efficiency with which the moisture condensation on the discharge surface 20A is prevented is further enhanced.

From the foregoing specific description of the embodiments, it will be readily understood that in some preferred embodiments of the ink jet recording apparatus of the present invention, the means for preventing the moisture condensation on the discharge surface of the recording head is constructed of moisture condensing members formed of a material which can maintain such members at a lower temperature than the discharge surface, i.e., a material which is higher in heat conductivity than the material forming the discharge surface, whereby the moisture condensation on the discharge surface can be effectively prevented, to thereby provide excellent stability of the recording performance.

The present invention is not restricted to the above-described embodiments, but may of course assume various constructions which can effectively prevent the moisture condensation on the discharge surface.

For example, in the above embodiments, description has been made of examples in which the moisture condensing members are provided on the platen 12 side, on carriage 16 or on the opposite sides of the recording head 20, but alternatively, these may be suitably combined.

[Embodiment 4]

Figure 7:
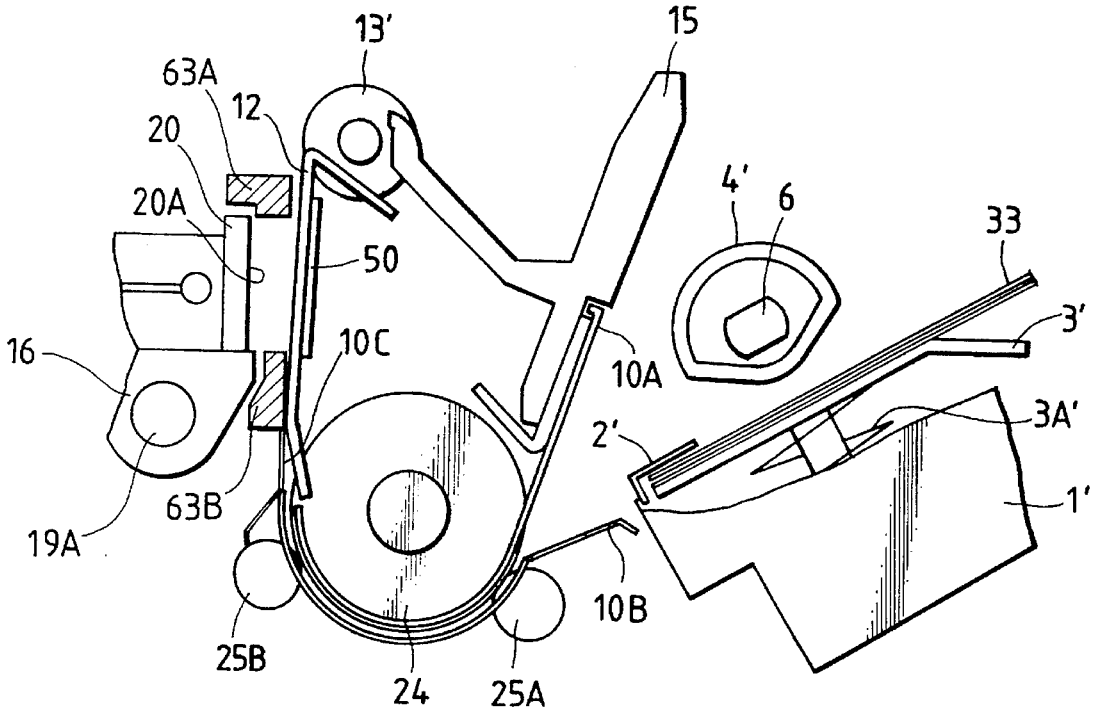
FIG. 7 is a schematic cross-sectional view showing an embodiment of the ink jet recording apparatus according to the present invention.

FIG. 7 is a schematic cross-sectional view showing the basic construction of Embodiment 4 of the present invention, and it substantially corresponds to FIG. 3. Accordingly, the basic construction of the apparatus according to this embodiment is similar to what has been previously described, and need not be described.

The difference of this embodiment from the previously described construction is that moisture absorbing members are provided as the moisture condensation-preventing means.

In FIG. 7, the reference characters 63A and 63B designate moisture absorbing members disposed downstream and upstream of the recording station on the conveyance path of the recording mediums and are formed of a moisture absorbing material or a moisture absorbing agent as will be described later. The moisture absorbing members 63A and 63B are constructed and arranged along the surface of the platen 12 in parallelism to the direction of movement of the recording head 20 so as not to hamper the recording operation of the recording head 20 by the discharge of liquid droplets, the conveyance of the recording mediums 33, and the movement of the recording head 20 and the carriage 16, so as to be capable of holding the steam in the space between the discharge surface and the recording surface. That is, the steam produced from the recording medium 33, such as paper, by the temperature rise of the recording medium 33 resulting from the driving of the fixating heater 50 and the steam produced by evaporation of the water content in the ink are collected on the moisture absorbing members 63A and 63B, whereby the amount of steam in the atmosphere near the discharge surface 20A is decreased and thus, moisture condensation on the discharge surface 20A can be prevented.

[Embodiment 5]

Figure 9:
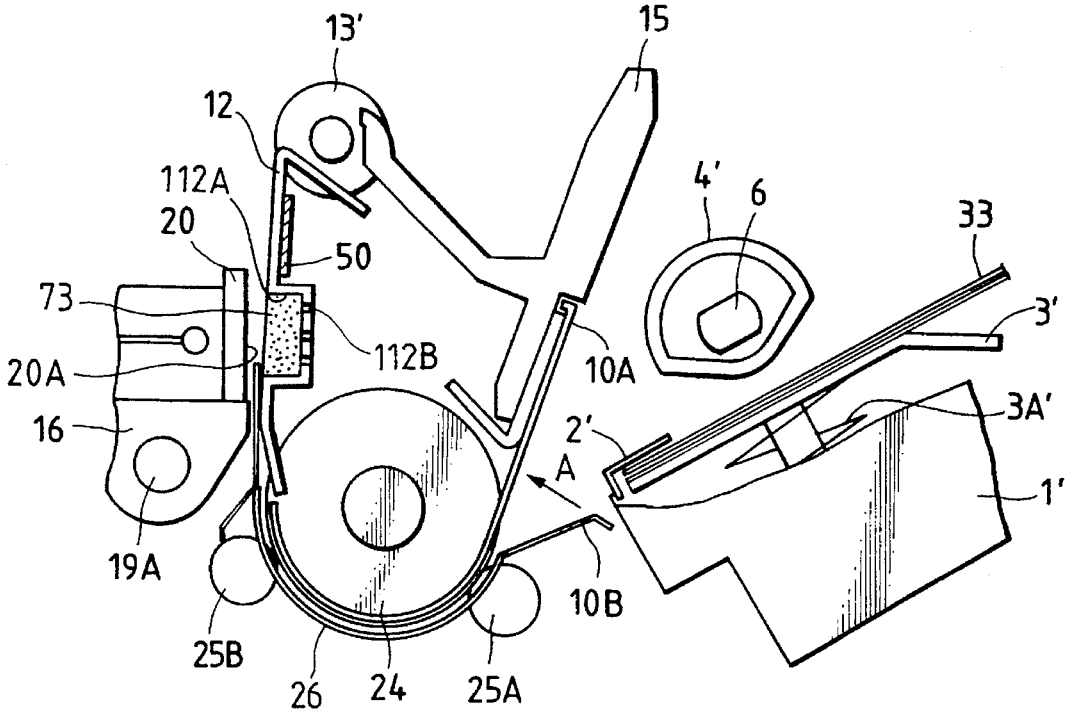
FIGS. 8 and 9 are a schematic perspective view and a cross-sectional view along the line X—X thereof, respectively, showing another embodiment of the ink jet recording apparatus according to the present invention.
Figure 8:
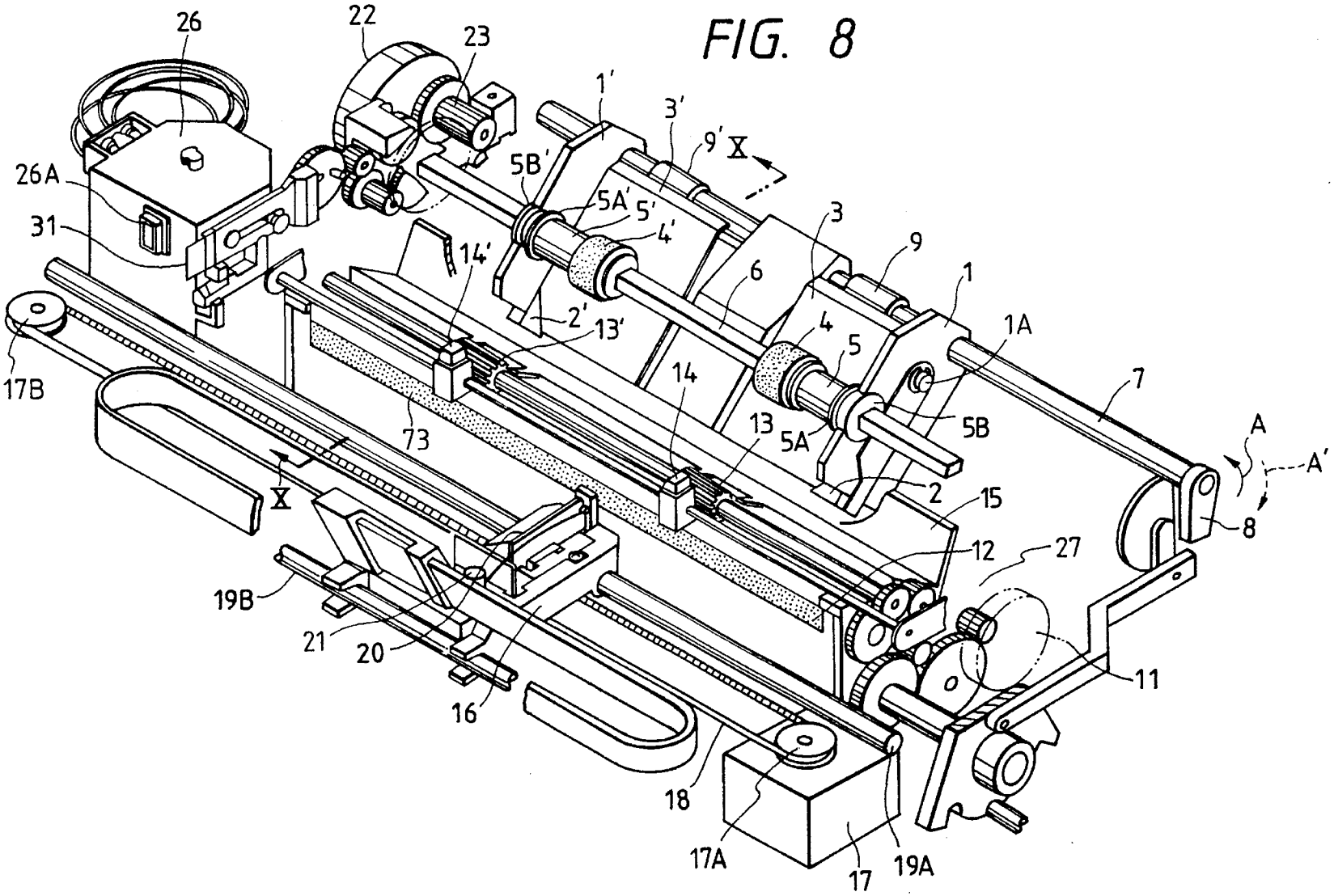

FIGS. 8 and 9 are a perspective view and a cross-sectional view on the line X—X of FIG. 8, respectively, showing another embodiment of the present invention. In these figures, portions which can be constructed similarly to those in the previously described embodiments are given similar reference characters and need not be described.

In the present embodiment, a platen 112 is formed with a recess 112A at a region opposed to the discharge surface 20A of the recording head 20, and a moisture absorbing member 73 is disposed in the recess 112A so that the recording surface may be controlled by the moisture absorbing member 73. A drain hole 112B for discharge of water is formed in the back of the recess 112A.

According to such a construction, the heat of the fixating heater 50 is conducted to the whole of the platen 112 and therefore, that portion of the recording medium which is in direct contact with the platen 112 is heated, and evaporation of the water content in the ink and evaporation of the water content contained in the recording medium 33 occur to improve the fixativeness. The steam thus produced is collected by the moisture absorbing member 73 and as a result, the moisture condensation on the discharge surface 20A is prevented or reduced. Also, in the present embodiment, the recording medium 33 and the platen 112 do not contact with each other on the recording surface and therefore, the water content in the ink is not evaporated, but evaporation takes place when the recording medium is conveyed to a region downstream thereof in the conveyance path and higher than the recording surface and thus, it becomes difficult for the steam produced by this evaporation to come near the discharge surface 20A of the recording head 20 and accordingly, the moisture condensation on the discharge surface 20A is prevented more effectively.

[Embodiment 6]

Figure 10A:
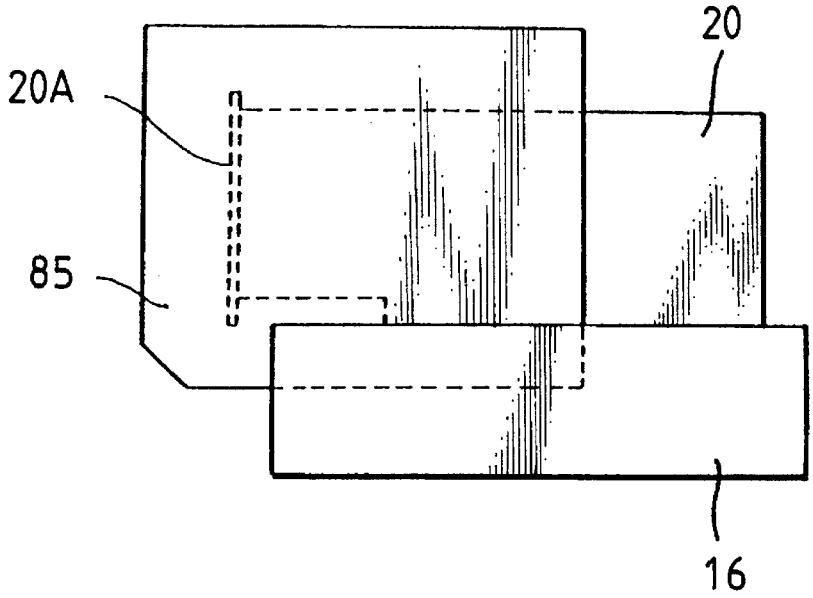
FIGS. 10A and 10B are a schematic side view and front view, respectively, showing the essential portions of still another embodiment of the present invention.
Figure 10B:
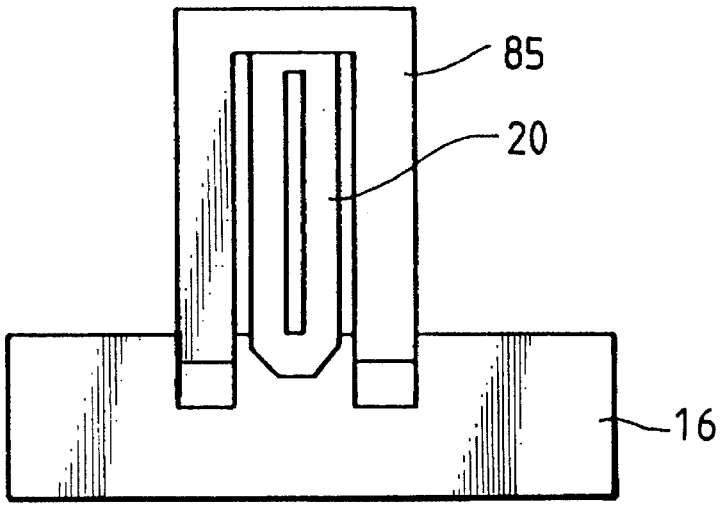

FIGS. 10A and 10B show still another embodiment of the present invention. In this embodiment, a moisture absorbing member 85 is disposed around the discharge surface 20A while being biased somewhat toward the platen 12 side by about ½ of the distance between the discharge surface and the recording surface.

Again in the present embodiment, the steam in the atmosphere near the discharge surface 20A is absorbed by the moisture absorbing member 85, and the moisture absorbing member 85 is biased more toward the platen 12 than the discharge surface 20A and therefore, the steam coming in from the platen 12 side is collected by the moisture condensing member 85 before it arrives at the discharge surface 20A and thus, the efficiency with which the moisture condensation on the discharge surface 20A is prevented is further enhanced.

In the above-described Embodiments 4–6, a moisture absorbing material or a moisture absorbing agent is used for the moisture absorbing member ( 63A, 63B, 73 or 85). As the moisture absorbing material, use can be made, for example, of a foamed material consisting of polyvinyl formal, polyethylene, polypropylene, polyurethane, polyvinyl alcohol, cellulose or the like, sponge, fiber, hair, cotton or the like.

Further, it is preferable to apply an interface activating agent or the like to these materials to enhance the hydrophilic property thereof and improve the moisture absorbing property.

On the other hand, as the moisture absorbing agent, use may be made, for example, of silica gel ($SiO_2.xH_2O$), sodium sulfate ($Na_2SO_4$), calcium chloride ($CaCl_2$) or the like. When using the moisture absorbing agent, if it is powder or particulate substance which is amorphous, the moisture absorbing agent can be contained in a suitable container formed with vent holes and such container can be disposed in the apparatus.

In constructing and installing these moisture absorbing members selection may be suitably made in conformity with the degree of the moisture absorbing property thereof.

According to the above-described embodiments, the moisture condensation on the discharge surface 20A can be prevented or remarkably reduced by reducing the humidity in the vicinity of the discharge surface.

The present invention is not restricted to the above-described embodiments, but can of course assume various constructions which can effectively prevent the moisture condensation on the discharge surface.

For example, in the above embodiments, description has been made of an example in which the moisture absorbing member is provided on the platen side or around the recording head 20, but alternatively, these may be suitably combined.

Also, the moisture absorbing member and the moisture condensing member may be suitably combined together.

In the present invention, the location at which the fixating heater 50 is disposed is not limited to the back side of the platen 12 which is opposed to the recording head 20 as in the above-described embodiments, but may be at any desired location on the conveyance path of the recording mediums at which fixation can be accomplished effectively.

As described above in detail, according to the present invention, the non-uniform wetting of the discharge surface 20A by moisture condensation does not occur and therefore, the direction of discharge, the speed of discharge and the particle diameters of the ink droplets from the discharge ports become stable and image recording of high quality becomes possible. Also, adherence of dust or paper powder to the discharge surface 20A which is liable to occur when the discharge surface 20A is wet due to moisture condensation can be prevented.

Further, when the ink overflows from the discharge ports to wet the discharge surface 20A due to the discharge recovering process by the suction or the like from the discharge ports using the head discharge recovering device 26 or due to a factor such as the vibration during the change-over of the reciprocal movement of the recording head 20, and further when water drops are produced by moisture condensation, the blade 31 in FIG. 2 or 8 is suitable for wiping such water drops and cleaning the discharge surface, but if this is frequently repeated, it is not inconceivable that the discharge surface 20A is roughened by the contact thereof with the blade 31 to thereby adversely affect the discharge of ink droplets. This may pose a problem particularly if a liquid repelling treatment is applied to uniformize the wetting property of the entire discharge surface 20A when the recording head 20 is formed by joining together a plurality of members formed of different materials (for example, the recording head disclosed in the applicant's Japanese Patent Applications Nos. 61-268493 to 61-268500). Even where the liquid repelling treatment is applied to the discharge surface 20A of the recording head as described above, according to the present embodiment, moisture condensation does not occur on the discharge surface 20A or can be remarkably reduced and therefore, the wiping mechanism itself can be omitted or the wiping operation can be omitted correspondingly to the reduced occurrence of moisture condensation, or at least the frequency of the wiping operation can be decreased.

Further, in the foregoing, description has been made with respect to the embodiments in which the present invention is applied to a so-called serial type printer, but of course, the present invention can also be applied to a line printer provided with a so-called full multi type recording head in which discharge ports are arranged over the full width of the recording medium. Also, the recording head may be one which is integrally provided with an ink tank containing ink therein and is removably mounted relative to the carriage.

[Embodiment 7]

Figure 11A:
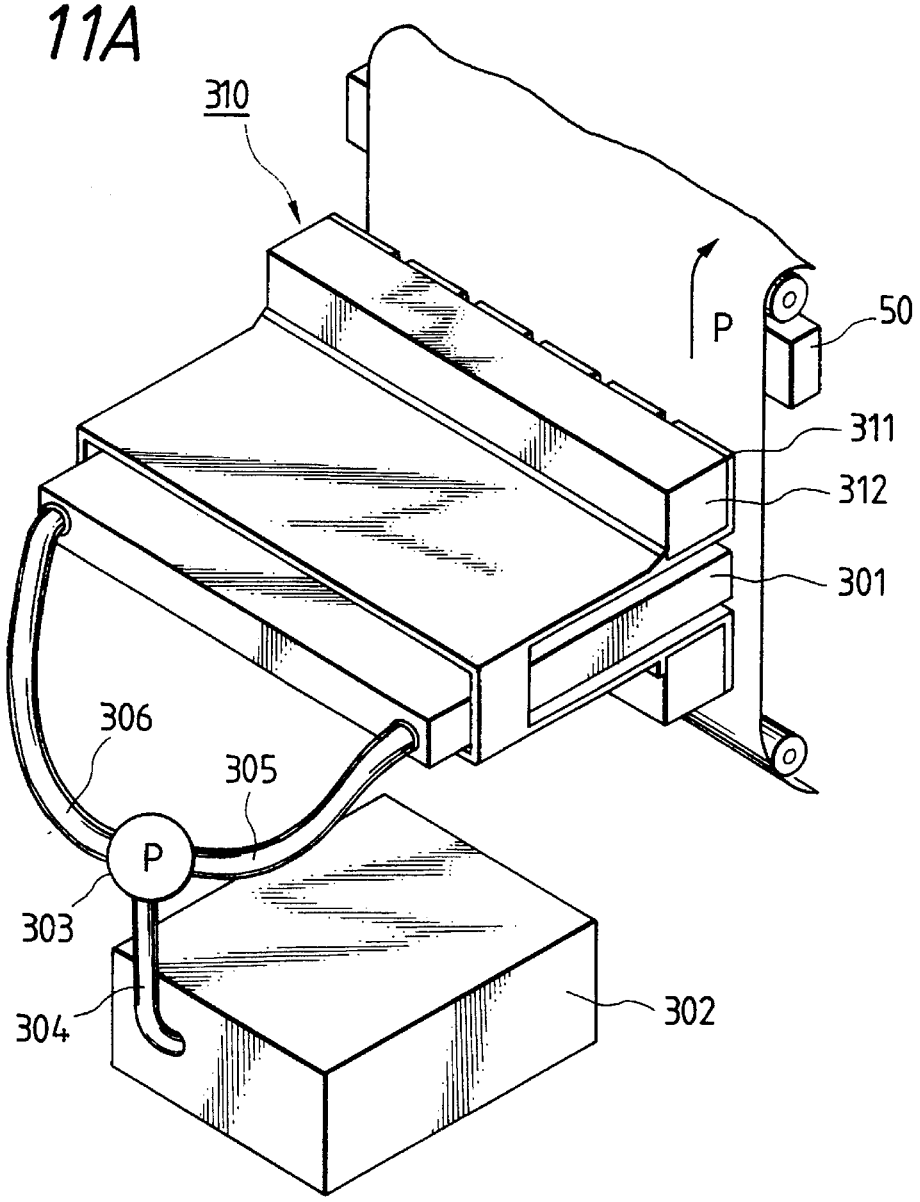
FIGS. 11A and 11B are schematic views showing an embodiment of the ink jet recording apparatus according to the present invention.
Figure 11B:
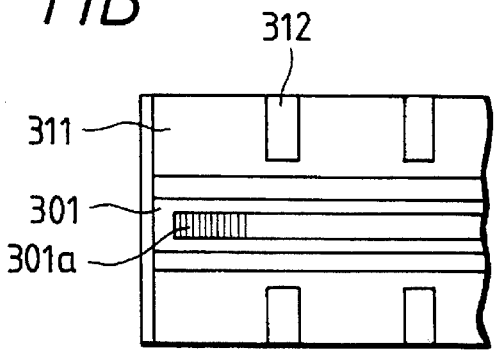

The full line printer, as schematically shown, for example, in FIGS. 11A and 11B, is of a construction in which moisture condensation preventing means 310 is disposed along the direction of arrangement of the discharge ports 301*a* of a recording head 301.

Here, the reference numeral 302 designates an ink tank containing therein ink to be supplied to the recording head by a supply pump 303, and the ink is supplied to the recording head 301 through supply tubes 304,305 and 306. Moisture condensation preventing means 310 is provided above and below the recording head, and the moisture condensation preventing means 310 comprises the afore-described moisture condensing member 311 and moisture absorbing member 312. The moisture absorbing member is removably disposed and is replaceable with a new one when its moisture absorbing power is reduced.

By thus combining the moisture condensing member and the moisture absorbing member, moisture condensation on the discharge surface of the recording head can be prevented more effectively and the effect thereof can be maintained for a long period of time.

Particularly, in the full multi type recording apparatus having many discharge ports, such a construction has been very effective.

Figure 13:
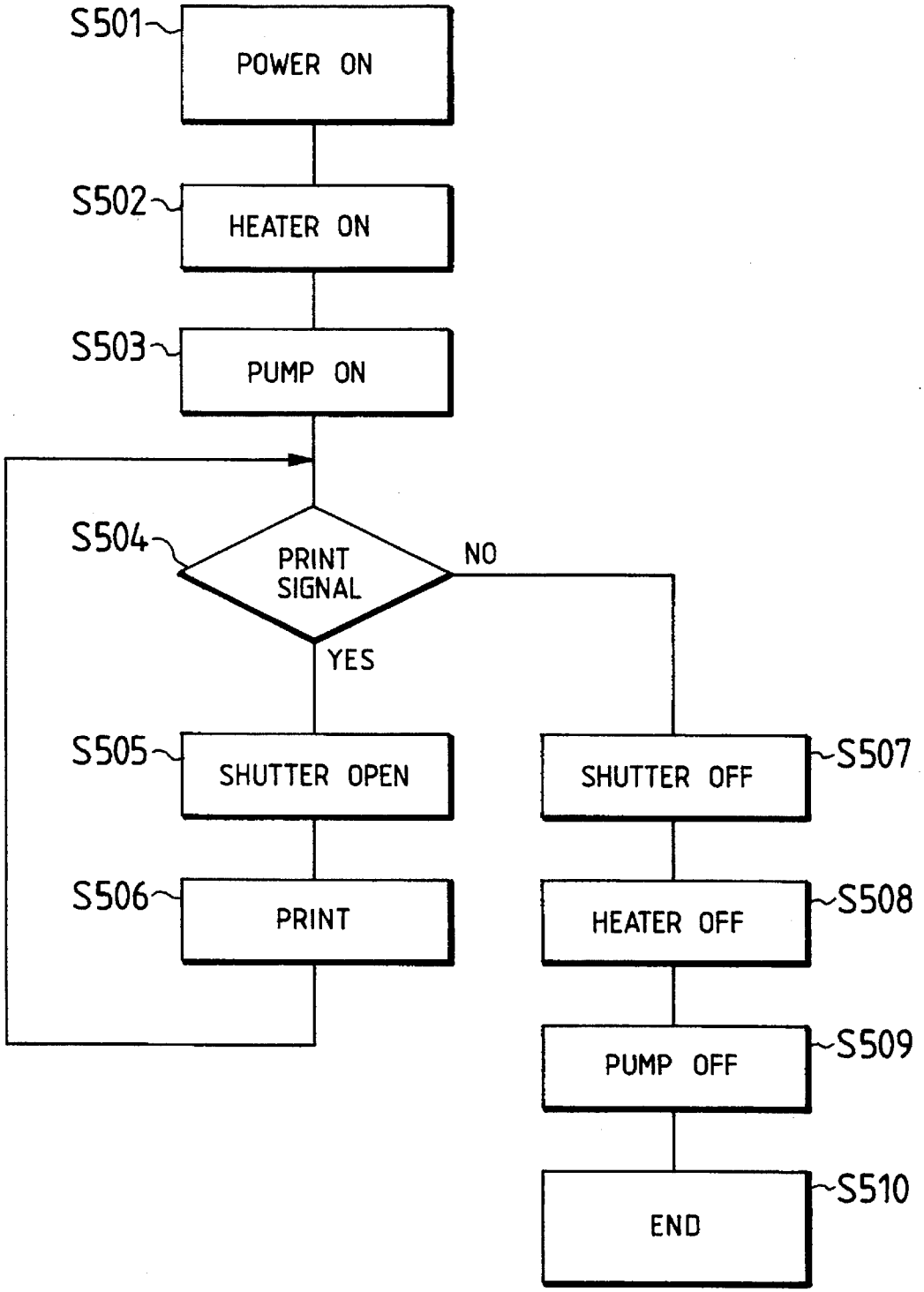
FIG. 13 is a flow chart showing an example of a moisture absorbing treatment operation in the above-stated embodiments.

FIG. 13 is a flow chart showing an example of the moisture absorbing process controlled by the above-described construction.

When the main switch is first closed, the heater 50 is driven to increase the temperature in the apparatus (S501 and S502). The pump 407 is also driven to cause the moisture absorbing capability of the moisture absorbing member 401 to be recovered (S503). When the recording data is input and a print signal is produced, the shutter 405 is opened and the recording head 20 is driven to effect recording (S504, S505 and S506). If the recording is terminated and the print signal is not produced, the shutter 405 is closed and the moisture absorbing process is terminated. At steps S508 and S509, the heater 50 and the pump 407 are stopped to terminate a series of operations concerned with recording (S510).

As described above, in the present embodiment, the moisture absorbing capability can be kept good and therefore, moisture condensation on the recording head can be prevented even in long-period use of the apparatus.

Also, the arrangement of the moisture absorbing mechanism, the construction of the recording head and the moisture absorbing process may be similar to those used in the aforedescribed embodiments.

[Embodiment 8]

Figure 12A:
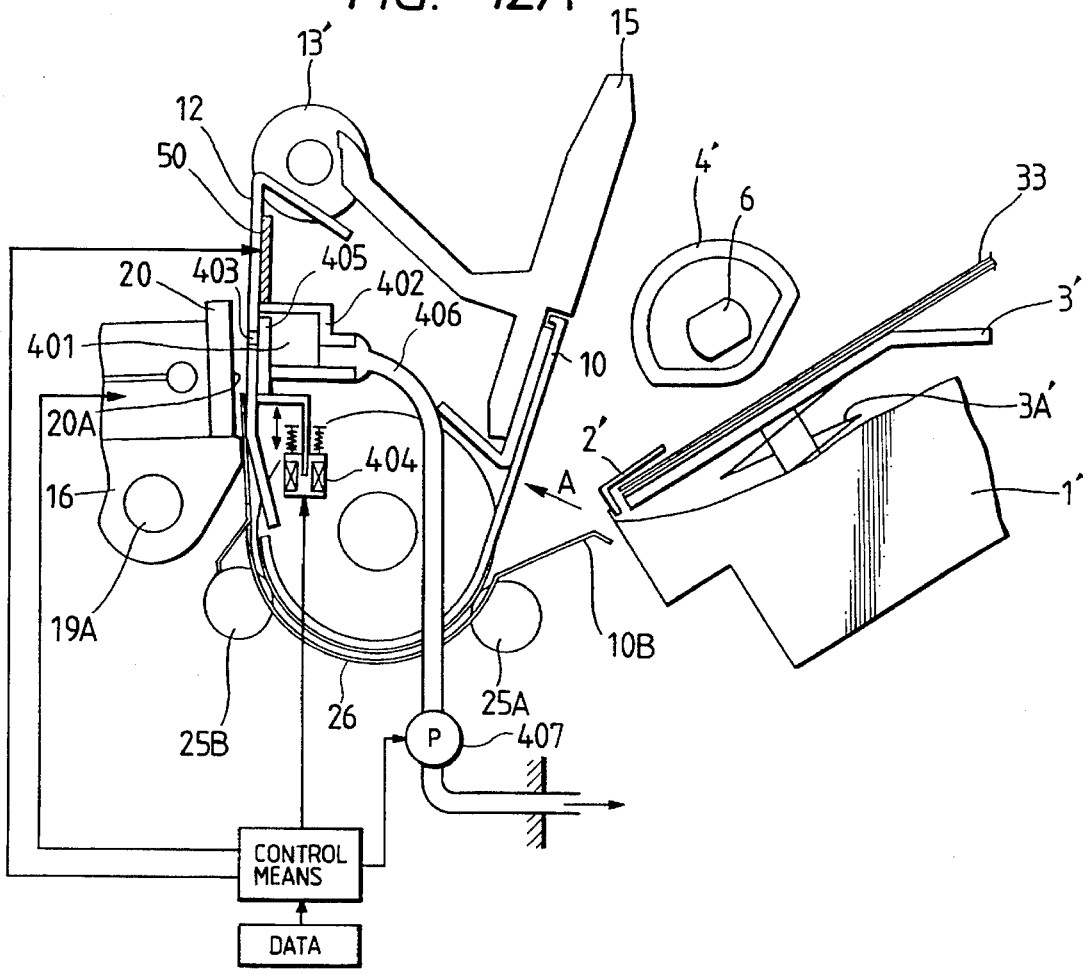
FIG. 12A is a schematic side cross-sectional view showing a further embodiment.

FIG. 12A is a schematic side cross-sectional view showing still another embodiment of the present invention.

The basic construction of this embodiment is similar to that of the aforedescribed Embodiment 6.

Figure 12B:
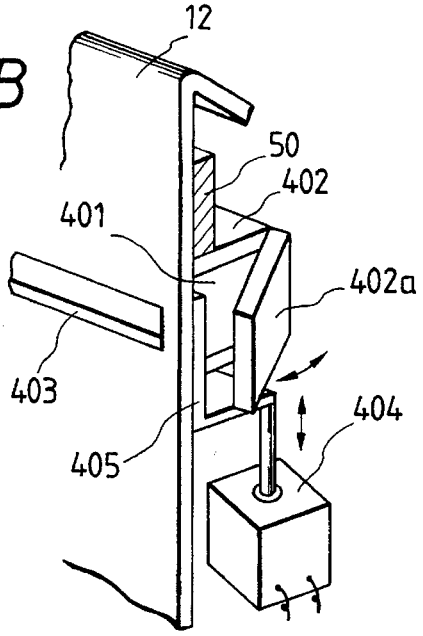
FIG. 12B is a side view showing the moisture absorbing mechanism of FIG. 12A in detail.

The difference in construction is the moisture absorbing mechanism. As shown in FIG. 12B, a moisture absorbing member 401 is hermetically inserted in a holding case 402, and is disposed rearwardly of the platen 12 having a moisture absorbing opening 403. The afore-mentioned materials may be used for the moisture absorbing member 401, and the moisture absorbing member is inter-changeable by opening and closing the lid **402*a* on a side of the holding case. A shutter 405 for opening and closing the interior of the holding case and the atmosphere in the apparatus is provided on that side of the holding case 402 which is adjacent to the platen 12, and in response, for example, to the recording signal, the driving of the fixating heater 50, a solenoid 404 is electrically energized, whereby opening-closing of the shutter 405 is suitably effected. Also, the water content retained by the moisture absorbing member 401 is discharged out of the apparatus by discharge means 407 comprising a pump or the like through a tube 406 communicating with the interior of the holding case 402. In this manner, the moisture absorbing capability of the moisture absorbing member 401** can be maintained good.

[Embodiment 9]

Figure 14:
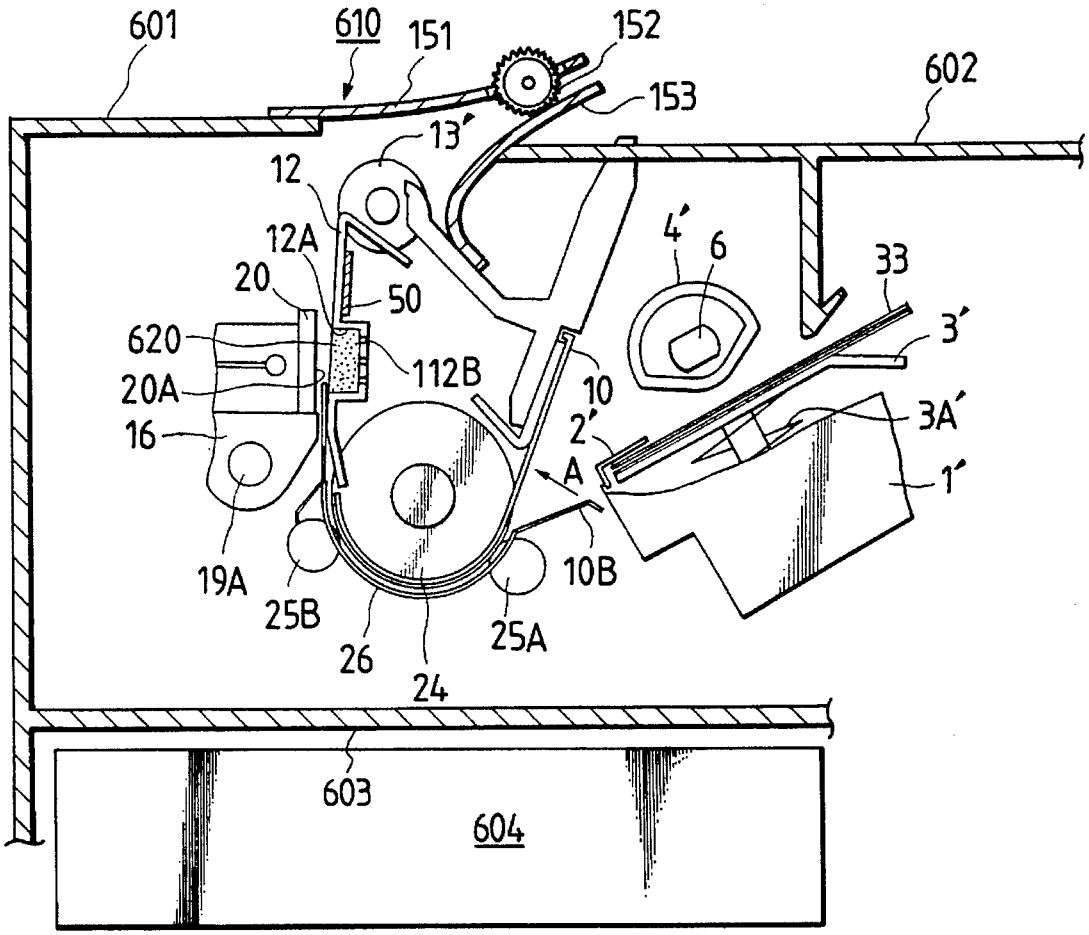
FIG. 14 is a schematic side cross-sectional view showing a further embodiment according to the invention.

FIG. 14 is a schematic side cross-sectional view showing yet still another embodiment of the present invention.

The basic construction of this embodiment is similar to that of Embodiment 6, but in this embodiment, a moisture absorbing member 620 reduces only the temperature in the apparatus and the water content outside the apparatus is retained so that the moisture absorbing capability thereof is not deteriorated. The portions of the apparatus concerned with recording are surrounded by an outer frame 601 and a tray 602, and a sheet discharge portion 610 for discharging the recording mediums is formed by a transparent sheet 151 for intimate contact and formed of plastic film, Myler film or the like and a sheet discharge guide sheet 153, and a plurality of pulleys of a diameter of 6–12 mm formed of metal, plastics or like material are disposed at predetermined locations to accomplish sheet discharge smoothly. In the lower portion of the apparatus, there is a containing portion 604 whose space is partitioned by a partition plate 603 and in which an ink tank, a control circuit are disposed. Thus, the recording medium, after recording, is guided to the sheet discharge portion 610 by the sheet discharge roller 13 and the sheet discharge guide 153 and is discharged out of the apparatus while rotating the pulleys 152, but since the opening in the sheet discharge portion 610 is very narrow, the interior of the apparatus can be kept in a low temperature condition.

Figure 15:
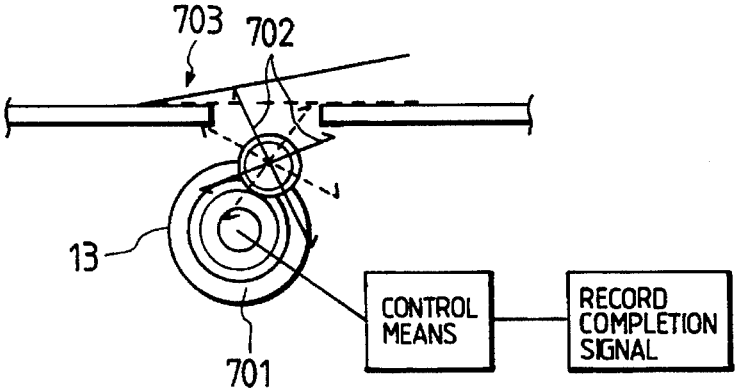
FIG. 15 shows an alternative example of the paper exhaust portion 610 shown in FIG. 14.

FIG. 15 shows another example of the sheet discharge portion 610 shown in FIG. 14. A gear 701 is provided in one end portion of the sheet discharge roller 13, and is engaged with a gear on the shaft of a leaf spring 702 lying above the gear 701. In the present embodiment, during the time that the recording signal is input and the recording operation is performed, the gear 701 is rotated to push up a sheet discharge cover 703 formed of plastics, glass or like material to thereby bring about a condition in which sheet discharge is possible.

When a recording termination signal is input, the recording medium is completely discharged by control means, whereafter the leaf spring 702 is rotated to a position indicated by a broken line and the discharge port is closed by a cover 703.

Where use is made of an ink jet recording head of the type which uses heat energy to discharge ink, it is more preferable to provide a pulley 152 shown in the figure so as to greatly decrease the influence of the humidity in the atmosphere while keeping the heat radiation of the head, than to hermetically seal the discharge port for discharging the recording material (a sheet or a resin sheet for OHP).

It is preferable to provide the pulley 152 at each end and design it so as to make the transparent sheet 151 and the sheet discharge guide sheet 15 more proximate to each other or in contact with each other in the central portion, but as an alternative, a plurality of such pulleys may be provided.

In any case, because of the construction in which the width of the discharge port is substantially smaller than that of the conventional discharge port, the stabilization of the humidity in the apparatus by the moisture absorbing effect can be achieved for a long period of time.

Also, the temperature keeping effect is improved and therefore, the drying of the ink can be quickened and in addition, there is a merit with that the moisture condensing conditions in the area of the head portion of the apparatus.

The construction as described above in which the communicating portion between the interior and exterior of the apparatus (for example, the sheet discharge portion) is made small is fully applicable to the aforedescribed embodiments.

As described above in detail, according to the present invention, in an ink jet recording apparatus provided with a heater for fixation, the amount of content of steam in the atmosphere near the recording head is decreased by the moisture condensation preventing means and therefore, the steam produced by heating can be prevented from condensing moisture on the discharge surface of the recording head or can be remarkably reduced and accordingly, during the discharge of ink, the direction of discharge and the speed of discharge of the ink and the particle diameters of the ink droplets can be stabilized and thus, image recording of high quality has become possible.

What is claimed is:

1. An ink jet recording apparatus comprising:

a recording head having at least one discharge port in a recording surface;

a heating member for heating a recording medium to expedite the fixation of liquid ink, discharged from one or more ink discharge ports in said recording surface of of said recording head and adhered to the recording medium, by promoting evaporation of the liquid ink adhered to the recording medium; and a moisture condensing member near the surface of the recording head in which the ink discharge ports are provided for decreasing the moisture in the area of the recording head created by the evaporation of the liquid ink, said moisture condensing member being maintained at a lower temperature than said recording surface of said recording head and more readily condensing moisture than said recording surface of said recording head.

2. An ink jet recording apparatus according to claim 1, wherein said recording head and said moisture condensing member are carried on a carriage moved in a predetermined direction relative to said recording medium.

3. An ink jet recording apparatus according to claim 2, wherein at least a portion of said moisture condensing member is positioned more forwardly in the direction of discharge than said surface.

4. An ink jet recording apparatus according to claim 1, further comprising a platen opposed to said ink discharge ports for controlling the recording surface of said recording medium, wherein said moisture condensing member is disposed along said platen.

5. An ink jet recording apparatus according to claim 1, wherein said moisture condensing member is formed of aluminum.

6. An ink jet recording apparatus according to claim 1, wherein said moisture condensing member is formed of copper.

7. An ink jet recording apparatus according to claim 1, wherein said recording head causes heat energy to act on the ink to thereby discharge the ink.

8. An ink jet recording apparatus according to claim 1, wherein said recording head has an electro-thermal conversion member producing heat energy as energy utilized for the discharge of the ink.

9. An ink jet recording apparatus according to claim 1, wherein said recording head includes an ink tank for containing the ink therein which is removably carried relative to a carriage.

10. An ink jet recording apparatus according to claim 1, wherein said recording head is of the full multi type.

11. An ink jet recording apparatus according to claim 1, wherein said heating member is a heater.

12. An ink jet recording apparatus comprising:

a recording head having at least one discharge port in a recording surface;

a heating member, provided in a vicinity of said recording head, for heating a recording medium to expedite the fixation of liquid ink discharged from one or more ink discharge ports in said recording surface of said recording head and adhered to the recording medium, by promoting evaporation of the liquid ink adhered to the recording medium; and a moisture absorbing member provided in a vicinity of a recording area in which the surface of said recording head is positioned for decreasing moisture in the recording area created by the evaporation of the liquid ink.

13. An ink jet recording apparatus according to claim 12, wherein said recording head and said moisture condensing member are carried on a carriage moved in a predetermined direction relative to said recording medium.

14. An ink jet recording apparatus according to claim 12, further comprising a platen opposed to said ink discharge ports for controlling the recording surface of said recording medium, wherein said moisture absorbing member is disposed along said platen.

15. An ink jet recording apparatus according to claim 12, wherein said moisture absorbing member includes at least one of the following materials:

polyvinyl formal, foamed polyethylene, foamed polypropylene, polyurethane foam, cellulose sponge, polyvinyl alcohol sponge, hair and cotton.

16. An ink jet recording apparatus according to claim 15, wherein said moisture absorbing member is made hydrophilic.

17. An ink jet recording apparatus according to claim 12, wherein said moisture absorbing member has at least one of silica gel, sodium sulfate and calcium chloride.

18. An ink jet recording apparatus according to claim 13, wherein said recording head causes heat energy to act on the ink to thereby discharge the ink.

19. An ink jet recording apparatus according to claim 12, wherein said recording head includes an electro-thermal conversion member for producing heat energy as energy utilized for the discharge of the ink.

20. An ink jet recording apparatus according to claim 12, wherein said recording head includes an ink tank for containing the ink therein which is removably carried relative to a carriage.

21. An ink jet recording apparatus according to claim 12, wherein said recording head is of the full multi type.

22. An ink jet recording apparatus according to claim 12, wherein said heating member is a heater.

23. An ink jet recording apparatus comprising:

a recording head for discharging liquid ink from one or more discharge ports provided in the recording head to a recording medium and effecting recording;

a heater for heating said recording medium to promote the evaporation of the liquid ink discharged onto the recording medium; and moisture condensation preventing means provided near a recording area in which said recording head is positioned and near a platen for decreasing moisture in the recording area and in the vicinity of the discharge ports created by the evaporation of the liquid ink, wherein said moisture condensation preventing means includes at least one of a moisture absorbing member and a member maintained at a lower temperature than said recording head to more readily condense moisture than said recording head.

24. An ink jet recording apparatus according to claim 23, wherein said moisture condensation preventing means includes a member higher in heat conducting than said recording head.

25. An ink jet recording apparatus according to claim 23, further comprising opening-closing means which is openable during the discharge of the recording medium out of the apparatus.

26. An ink jet recording apparatus according to claim 23, further comprising a sheet member that is provided in a sheet discharge portion.

27. An ink jet recording apparatus in which liquid ink is discharged from one or more discharge ports provided in a recording head and adhered to a recording medium to thereby effect recording comprising:

a) a heating member for heating said recording medium to promote the evaporation of the liquid ink discharged onto the recording medium; and b) moisture removing means including a housing member having therein a moisture absorbing-member provided in a vicinity of a recording area for decreasing the moisture in the vicinity of the discharge ports created by the evaporation of the liquid ink, and opening-closing means for opening and closing an opening provided in said housing member.

28. An ink jet recording apparatus according to claim 27, further comprising means communicating with the interior of said housing member for discharging the water content in said housing member out of the apparatus.

29. An ink jet recording apparatus according to claim 27, further comprising means for driving said opening-closing means on the basis of the recording operation.

30. An ink jet recording apparatus according to claim 27, further comprising means for driving said opening-closing means on the basis of the driving of said heating member.

31. An ink jet recording apparatus according to claim 27, wherein said moisture absorbing member is formed of at least one of the following materials:

polyvinyl formal, polyethylene, polypropylene, polyurethane, polyvinyl alcohol, cellulose, hair, cotton, silica gel, sodium sulfate and calcium chloride.

32. An ink jet recording apparatus according to claim 27, wherein said moisture absorbing member is subjected to a treatment for enhancing its hydrophilic property.

33. An ink jet recording apparatus according to claim 27, wherein said moisture removing means is provided in the vicinity of a platen.

34. An ink jet recording apparatus according to claim 27, wherein said recording head is a head that produces images by the use of a recording liquid which utilizes heat energy for forming droplets of the recording liquid.

35. An ink jet recording apparatus according to claim 27, wherein said recording head has an electro-thermal conversion member.

* * * * *

UNITED STATES PATENT AND TRADEMARK OFFICE

CERTIFICATE OF CORRECTION

PATENT NO. : 5,500,658 Page 1 of 2

DATED : March 19, 1996

INVENTOR(S) : Yoshifumi HATTORI, et al.

It is certified that error appears in the above-indentified patent and that said Letters Patent is hereby corrected as shown below:

COLUMN 1:

Line 23, "apparatus-has" should read --apparatus has--.

COLUMN 3:

Line 12, "consideration," should read --consideration--;

Line 13, "conditions" should read --conditions,--.

COLUMN 6:

Line 56, "3′," should read --13′,--.

COLUMN 13:

Line 37, "afore-mentioned" should read --aforementioned--;

Line 39, "inter-changeable" should read --interchangeable--.

UNITED STATES PATENT AND TRADEMARK OFFICE

CERTIFICATE OF CORRECTION

PATENT NO. : 5,500,658 Page 2 of 2

DATED : March 19, 1996

INVENTOR(S) : Yoshifumi HATTORI, et al.

It is certified that error appears in the above-indentified patent and that said Letters Patent is hereby corrected as shown below:

COLUMN 14:

Line 49, "that" should be deleted.

COLUMN 16:

Line 22, "has" should read --includes--;
Line 24, "claim 13," should read --claim 12,--.

COLUMN 17:

Line 7, "absorbing-member" should read --absorbing member--.

Signed and Sealed this

Thirtieth Day of July, 1996

Bruce Lehman

*Attest:*

BRUCE LEHMAN

*Attesting Officer*

*Commissioner of Patents and Trademarks*